United States Patent [19]

Lesniak

[11] Patent Number: 4,513,811

[45] Date of Patent: Apr. 30, 1985

[54] HEAT EXCHANGER

[75] Inventor: Thomas A. Lesniak, South Bend, Ind.

[73] Assignee: Ex-Cell-O Corporation, Troy, Mich.

[21] Appl. No.: 530,459

[22] Filed: Sep. 9, 1983

[51] Int. Cl.[3] ..... F28F 7/00; F28F 7/02

[52] U.S. Cl. ..... 165/79; 165/173

[58] Field of Search ..... 165/173, 175, 79

[56] References Cited

U.S. PATENT DOCUMENTS 2,488,627 11/1949 Hisey ..... 165/175 X 3,027,142 3/1962 Albers et al. ..... 165/175 X

FOREIGN PATENT DOCUMENTS 2449070 5/1975 Fed. Rep. of Germany ..... 165/173

*Primary Examiner*—Allen M. Ostrager

*Attorney, Agent, or Firm*—John P. Moran

[57] ABSTRACT

A heat exchanger wherein the tubes are connected to the headers by soldering. Specifically, the tubes extend through and a predetermined distance beyond vertically flanged openings in a header. The tubes include vertical slits formed in a spaced relationship in opposite side walls thereof in the end portion which extends beyond the header flanges. The wall portion between the slits is folded in a curled configuration toward the vertical flanges until the edges of the curled wall contact the flanges. Solder is applied by capillary action between the tubes and the inner surfaces of the flanges and in the space between the outer surfaces of the flanges and the curled tube portions.

3 Claims, 3 Drawing Figures

HEAT EXCHANGER

TECHNICAL FIELD

This invention relates generally to heat exchangers and, more particularly, to a tube-to-header connection therefor.

BACKGROUND ART

Heretofore, various techniques have been used to connect the tubes to the headers, and have been found to be generally satisfactory. However, it is always desirable to attempt to attain a longer life, leak-proof joint which remains rigid throughout vibrations and movements caused by pressure and temperature variables, while being economically feasible.

DISCLOSURE OF INVENTION

Accordingly, a general object of the invention is to provide an improved tube-to-header joint which is efficient in operation, durable, and economical to manufacture.

Another object of the invention is to provide a tube-to-header joint wherein oblong tubes, having vertical slits formed approximately at the juncture between the flat side and each round end, are extended through vertically flanged openings formed in a header, and the flat sides curled downwardly into contact with the outer surfaces of the vertical flanges, with solder, as a result of capillary action, included between the tube and the flange and between the flange and the curled section.

These and other objects and advantages will be apparent when reference is made to the following description and accompanying drawings.

BEST MODE OF CARRYING OUT THE INVENTION

Figure 1:
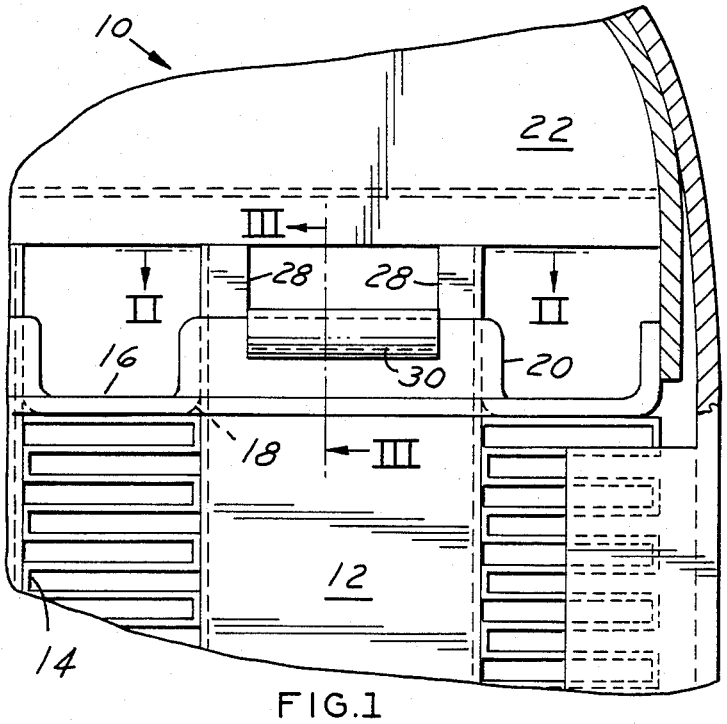
FIG. 1 is a front elevational view of a heat exchanger embodying the invention.

Referring now to the drawings in greater detail, FIG. 1 illustrates a heat exchanger 10 including a tube pack or core assembly made up of a plurality of tubes 12 and fins 14. A header 16 is mounted on each end of the tube pack, with the tubes 12 extending through openings 18 formed in the headers. The fins 14 may be serpentine type fins, as shown, or transversely oriented flat sheet metal fins. The tubes 12 may be oblong, oval, round, or square in shape. Typically, for an oblong-shaped tube, the material of each header 16 is such that, after initially forming slits (not shown) in the header, openings 18 are formed by projecting the edge portions adjacent each slit outwardly to form a vertical flange 20 around the opening. A tank 22 is mounted on each header 16.

Figure 2:
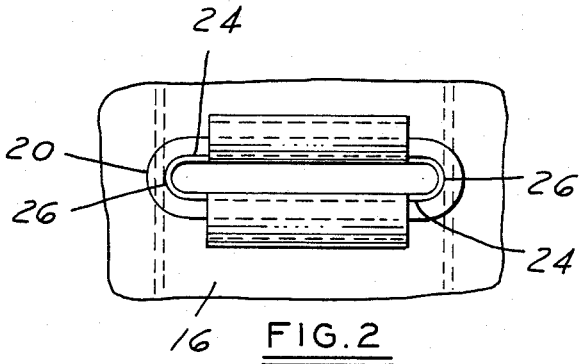
FIGS. 2 and 3 are cross-sectional views taken along the planes of the lines II—II and III—III, respectively, of FIG. 1, and looking in the directions of the arrows.
Figure 3:
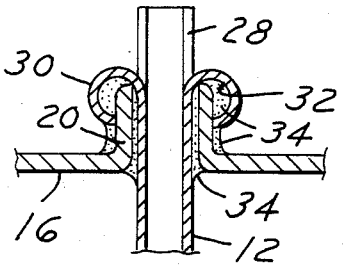

As shown in FIGS. 2 and 3, the tubes 12 are oblong in shape, i.e., they each include two flat sides 24 and two interconnecting rounded ends 26. Each tube 12 includes spaced vertically oriented slits 28 formed at approximately the juncture between each flat side 24 and each rounded end 26. The slitted tube extends through an opening 18 and a predetermined distance beyond the end of the associated flange 20 formed on the header 16.

The flat sides 24 between the spaced slits 28 are curled vertically toward and into contact with the outer surfaces of the respective flanges 20, forming a curled section 30 with a space 32 provided between the curled section and the flange 20.

During the soldering process, solder 34, as a result of capillary action, fuses between the tube 12 and the adjacent flange 20 on the inside of the flange, and fills the space 32 between the flange 20 and the curled section 30 on the outside of the flange, producing a strong, physical, leak-proof joint between the flange and the tube, which remains rigid throughout vibrations and movements caused by pressure and temperature variables.

INDUSTRIAL APPLICABILITY

It should be apparent that the invention provides an efficient, durable and economical mechanical bond between tubes and headers.

While only oblong tubes have been shown and described in conjunction with flanged headers, it should be apparent that other tube and flange arrangements, e.g., round, oval, or square, are possible within the scope of the fused tube-to-header joint assembly.

The embodiments of the invention in which an exclusive property or privilege is claimed are defined as follows:

1. A heat exchanger comprising upper and lower headers, a plurality of aligned openings formed in the headers and each having outwardly extending flanges formed therearound, a plurality of tubes mounted between the headers and extended through said aligned openings and having end portions thereof extended beyond said outwardly extending flanges, a pair of spaced vertical slits formed on each of opposite sides of said extended end portions of said tubes, said tube portions between said vertical slits being curled toward and into engagement with said flanges, and solder applied between said tubes and the inner surfaces of said flanges and between the outer surfaces of said flanges and said curled tube portions.

2. The heat exchanger described in claim 1, wherein each of said tubes is formed to include oppositely disposed parallel sides interconnected by round end portions, and said vertical slits are formed at the approximate juncture between said parallel sides and said round end portions.

3. A heat exchanger comprising upper and lower headers, a plurality of aligned, elongated openings formed in the headers and each having vertically oriented, outwardly extending flanges formed therearound, a plurality of oblong tubes mounted between the headers and extended through said aligned openings and having end portions thereof extended beyond the ends of said flanges, said oblong tubes being formed to include oppositely disposed flat sides interconnected by round end portions, a pair of spaced vertical slits formed on each of opposite flat sides of said extended end portions of said oblong tubes in the vicinity of the juncture between said flat sides and said round end portions, said tube portions between said vertical slits being curled toward said flanges such that the free lateral edges of said curled flat sides abut against said flanges, and solder confined between said tubes and the inner surfaces of said flanges and in the space between the outer surfaces of said flanges and said curled tube portions as a result of capillary action.

* * * * *